US008668011B2

(12) United States Patent
Mack et al.

(10) Patent No.: US 8,668,011 B2
(45) Date of Patent: Mar. 11, 2014

(54) METHOD OF HYDRAULICALLY FRACTURING A FORMATION

(75) Inventors: Lance William Mack, Calgary (CA); Daniel James Schlosser, High River (CA); Darcy Allan Schultz, Calgary (CA)

(73) Assignee: Baker Hughes Incorporated, Houston, TX (US)

( * ) Notice: Subject to any disclaimer, the term of this patent is extended or adjusted under 35 U.S.C. 154(b) by 506 days.

(21) Appl. No.: 12/958,187

(22) Filed: Dec. 1, 2010

(65) Prior Publication Data

US 2011/0127038 A1 Jun. 2, 2011

(51) Int. Cl.
*E21B 43/26* (2006.01)

(52) U.S. Cl.
USPC ..... 166/308.1

(58) Field of Classification Search
USPC ..... 166/305.1, 308.1, 298
See application file for complete search history.

(56) References Cited

U.S. PATENT DOCUMENTS

| | | | |
|---|---|---|---|
| 3,692,114 | A | 9/1972 | Murphey, Jr. et al. |
| 6,176,307 | B1 | 1/2001 | Danos et al. |
| 2002/0117301 | A1 | 8/2002 | Womble |
| 2003/0200995 | A1 | 10/2003 | Walker et al. |
| 2009/0078461 | A1 | 3/2009 | Mansure et al. |

FOREIGN PATENT DOCUMENTS

| | | | |
|---|---|---|---|
| GB | 2316967 | B | 11/2000 |

OTHER PUBLICATIONS

International Search Report received on the corresponding international application No. PCT/CA2010/001922, dated Mar. 8, 2011.

*Primary Examiner* — David Andrews
(74) *Attorney, Agent, or Firm* — Bereskin & Parr LLP/S.E.N.C.R.L., s.r.l.; Philip C. Mendes da Costa

(57) ABSTRACT

A method of hydraulically fracturing a formation comprises controlling a pump rate during hydraulic fracturing of the first section of the horizontal well bore during a first period to break down the formation while reducing pick up of sand positioned in the well bore; during a subsequent second period to pick up the sand positioned in the well bore generally at a rate at which the formation will accept the sand; and, during a subsequent third period to fracture the formation.

11 Claims, 6 Drawing Sheets

| | |
|---|---|
| WH Press (MPa) | ——— |
| Coil Press (MPa) | – · – · – |
| WH Density (kg/m$^3$) | ··· ··· |
| Density at Perfs (kg/m$_3$) | ····· |
| Comb Rate (m$_3$/min) | – – – – |

METHOD OF HYDRAULICALLY FRACTURING A FORMATION

FIELD

This invention relates to the hydraulic fracturing of a generally horizontal section of a well wherein the rate of fluid flow is controlled to control the sand re-entrainment of residual sand in the horizontal section of the well, from previous operations such as abrasive perforating or previous hydraulic fracture treatments, to ensure the sand does not impede the progression of further hydraulic fracturing treatments in future intervals of the well.

INTRODUCTION

Hydraulic fracturing consists of pumping fluid and proppant at high pressures and rates to create a fracture in a downhole formation. The high pressure results in the formation fracturing. Continued pumping at high pressure and rates results in the fractures extending further into the formation. A proppant is placed within the fractures that are created in the formation. This results in the fracture remaining propped open after the pressure is withdrawn. The fractures provide access to an increased reservoir area and allow increased flow into the well due to the decreased pressure drop in the fracture compared to the well bore.

Hydraulic fracturing can be completed numerous ways with different completion techniques. One completion technique that is utilized is to extend a generally vertical well bore horizontally (e.g., 1000-2000 meters) and cement the casing string. The casing may extend from the distal end of the horizontal section of the well bore to the surface. The casing and cement create a solid barrier member lining the formation. As used herein, the term "barrier member" is used to refer to such a casing and cement construct as well as other such constructs that may be used, including only a casing or multiple layers of casing and/or cement or the like. To hydraulically fracture the well, coil tubing may be used to abrasively perforate sections of the well. For example, the horizontal section of the well may be sequentially subjected to fracturing.

If the casing has been placed in the horizontal section and cemented, then abrasive perforating may be utilized to perforate the casing to establish a connection to the reservoir prior to the hydraulic fracturing operation. Abrasive perforating consists of pumping sand laden fluid through the coil tubing, and then through an outlet known as an abrasive perforator tool that is provided at the end of the coil tubing. The abrasive perforating cuts holes through the casing and the cement to establish the connection to the reservoir. As a result of this operation, residual sand may be left on the lower side of the casing (i.e. between the coil tubing and the casing). After the holes have been cut through the casing and the cement, the formation may then be hydraulically fractured. The initial process is to break down the formation. This process may take only seconds. However, in some cases it may take up to hours. Once breakdown occurs, a hydraulic fracturing fluid is pumped downhole via the annulus between the casing and the coil tubing thereby extending the fractures further into the formation.

The horizontal section may be fractured in zones. After a first zone is treated, that zone may be isolated from the next section to be fractured, such as by sanding off the perforations (plugging) or by mechanical isolation such as a packer. The coil tubing may be moved further uphole (towards the surface) and the process repeated. During these processes, sand will tend to build up between the coil tubing and the bottom of the casing in the horizontal portion. In order to remove the sand, fluid may be pumped down the coil tubing and a return flow directed up the annulus between the coil tubing and the casing. Due to limitations of flow rate down the coil and velocities in the annulus and the volumes pumped down the coil, sometimes the sand may tend to be deposited in the horizontal section of the well bore or at the bend between the horizontal and vertical sections of the well. This residual sand may impede the treatment of the next zone of the horizontal section of the well bore.

SUMMARY

In accordance to the invention, a method is provided for treating a formation wherein the residual sand in the horizontal well bore does not prevent the fracturing of the formation. In accordance to this process, a flow regime is utilized such that the hydraulic fracturing may proceed without being impeded by re-entrainment of sand. Further, the process may be conducted so as to re-entrain sand in the horizontal well bore and utilize that sand as part of a fracturing operation. An advantage of this process is that a horizontal well bore may be reliably fractured with numerous treatments from the toe of the well to the heel, without an intermediate zone being sanded off which can result in termination of the stimulation treatment. Further, the method can result in re-entrainment of sand which is present in the horizontal section of the well thereby reducing the likelihood that additional fracturing operations may be impeded by the sand in the well bore.

Therefore, in accordance with a first aspect of this invention there is provided a method of hydraulically fracturing a formation comprising:

(a) abrasively perforating a barrier member positioned in a first section of horizontally extending well bore;

(b) controlling a pump rate during hydraulic fracturing of the first section of the well bore (i) during a first period to break down the formation while reducing pick up of sand positioned in the well bore;

(ii) during a subsequent second period to pick up the sand positioned in the well bore generally at a rate at which the formation will accept the sand; and, (iii) during a subsequent third period to fracture the formation.

In one embodiment, the method further comprises:

(a) hydraulically fracturing a distal section of a the well bore positioned closer to a heel of the well bore then the first section; and, (b) isolating the distal section from a first section of the well bore prior to abrasively perforating the barrier member positioned in the first section In another embodiment, the method further comprises abrasively perforating a barrier member positioned in the distal section of the well bore prior to hydraulically fracturing the distal section.

In another embodiment, the pump rate varies during each of the first period and the second period.

In another embodiment, straight fluid is used during the first period and/or second periods. Preferably, fluid that includes a proppant is used during the third period.

In another embodiment, during the second period, the pump rate is increased from time to time and the pumping monitored to determine if the sand has been picked up from the well bore prior to commencing the third period.

In another embodiment, in the first period, the pump rate is less than 1 $m^3$/min.

In another embodiment, in the second period, the pump rate is greater than 0.3 $m^3$/min.

In another embodiment, the method further comprises monitoring the well head pressure and reducing the flow rate of a hydraulic fracturing fluid during the first and second periods when a pressure increase indicates that sand off of the formation has occurred.

In accordance with another aspect of this invention there is provided a method of hydraulically fracturing a formation comprising:

(a) providing a well bore in the formation having a first vertical portion and a second portion extending at an angle to the vertical portion and having coil tubing extending in the second portion wherein sand is positioned in the well bore;

(b) subjecting a section of the second portion of the well bore to hydraulic fracturing wherein the pump rate of the fracturing fluid is controlled according to a pump rate regime during a first period to initially break the formation while reducing sanding off and during a second period to re-entrain residual sand left in the second portion while reducing sanding off and subsequently during a third period at a higher rate to fracture the formation.

In one embodiment, the method further comprises hydraulically fracturing a first section of the well bore and subsequently conducting step (b) on an upstream section of the well bore.

In one embodiment, the method further comprises isolating the first section of the well bore prior to conducting step (b) on the upstream section of the well bore.

In one embodiment, the first section of the well bore is isolated by sanding off.

In one embodiment, the first section of the well bore is isolated by mechanical isolation.

In one embodiment, a barrier member is positioned in the well bore and the method further comprises abrasively perforating the barrier member prior in the upstream section of the well bore prior to hydraulically fracturing the upstream section of the well bore.

In one embodiment, the method further comprises monitoring the well head pressure and reducing the flow rate of a hydraulic fracturing fluid during the first period when a pressure increase indicates that sanding off of the formation has occurred.

In one embodiment, the second period is subsequent to formation break down.

In one embodiment, in the first period, the pump rate is less than 1 $m^3$/min.

In one embodiment, in the second period, the pump rate is greater than 0.3 $m^3$/min.

In one embodiment, straight fluid is used during the first period and/or second.

In one embodiment, fluid that includes a proppant is used during the third period.

In one embodiment, during the second period, the pump rate is increased from time to time and the pumping monitored to determine if the sand has been picked up from the well bore, prior to commencing the third period.

DRAWINGS

These and other advantages of the instant invention will be more fully and completely understood in conjunction with the following description of the preferred embodiments of the invention:

DESCRIPTION OF VARIOUS EMBODIMENTS

Various apparatus or methods will be described below to provide an example of the claimed invention. No example described below limits any claimed invention and any claimed invention may cover processes or apparatuses that are not described below. The claimed inventions are not limited to apparatus or processes having all the features of any one apparatus or process described below or to features, common to multiple or all of the apparatuses described below. It is possible that an invention or process described below is not an embodiment of any claimed invention.

Figure 1:
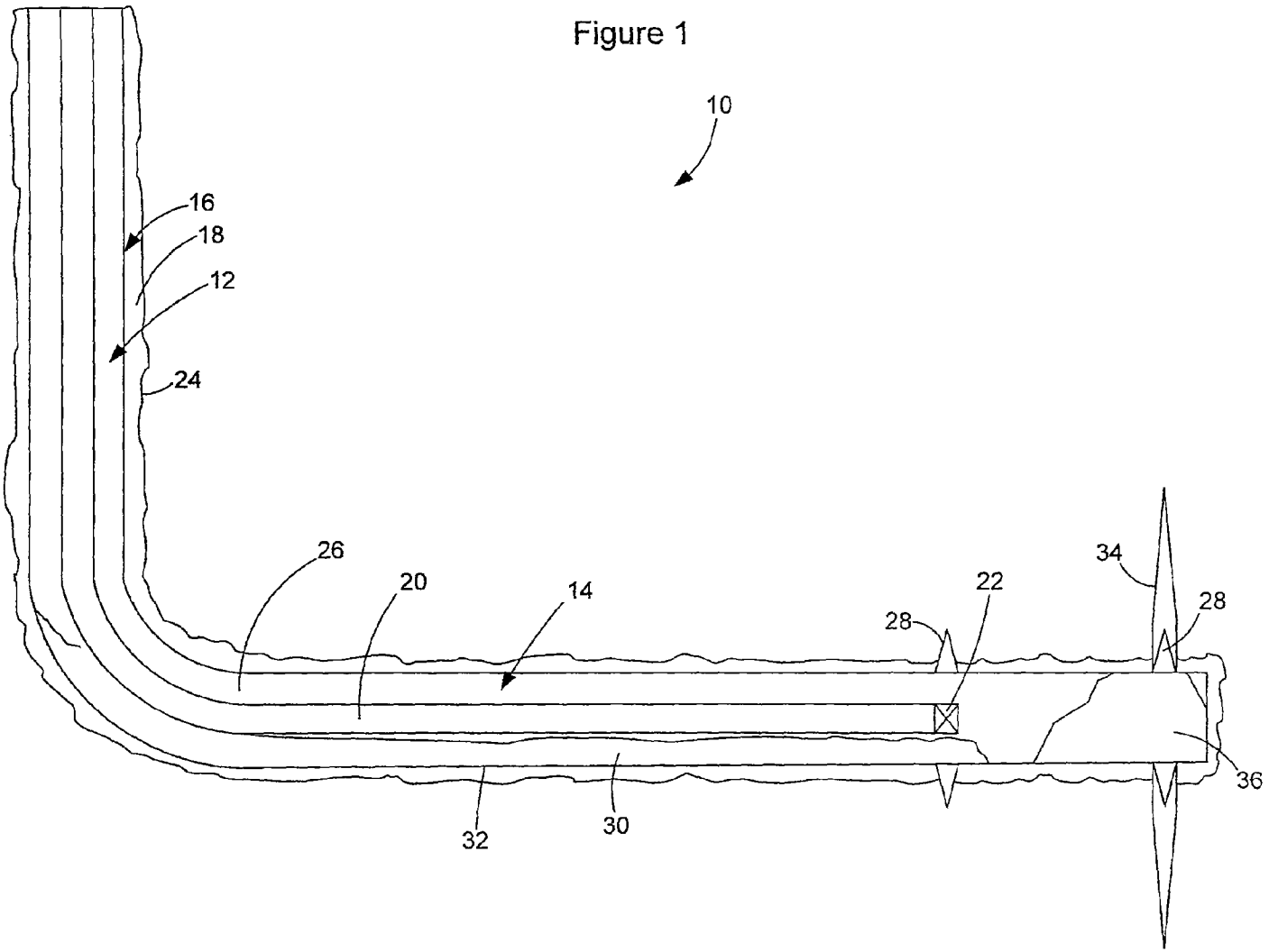
FIG. 1 is a schematic drawing of a cross-section through a well having a first zone or interval that has been abrasively perforated and hydraulically fractured with a sand plug placed to provide zonal isolation, a second zone that has been perforated and with residual sand on the bottom of the casing.
Figure 2:
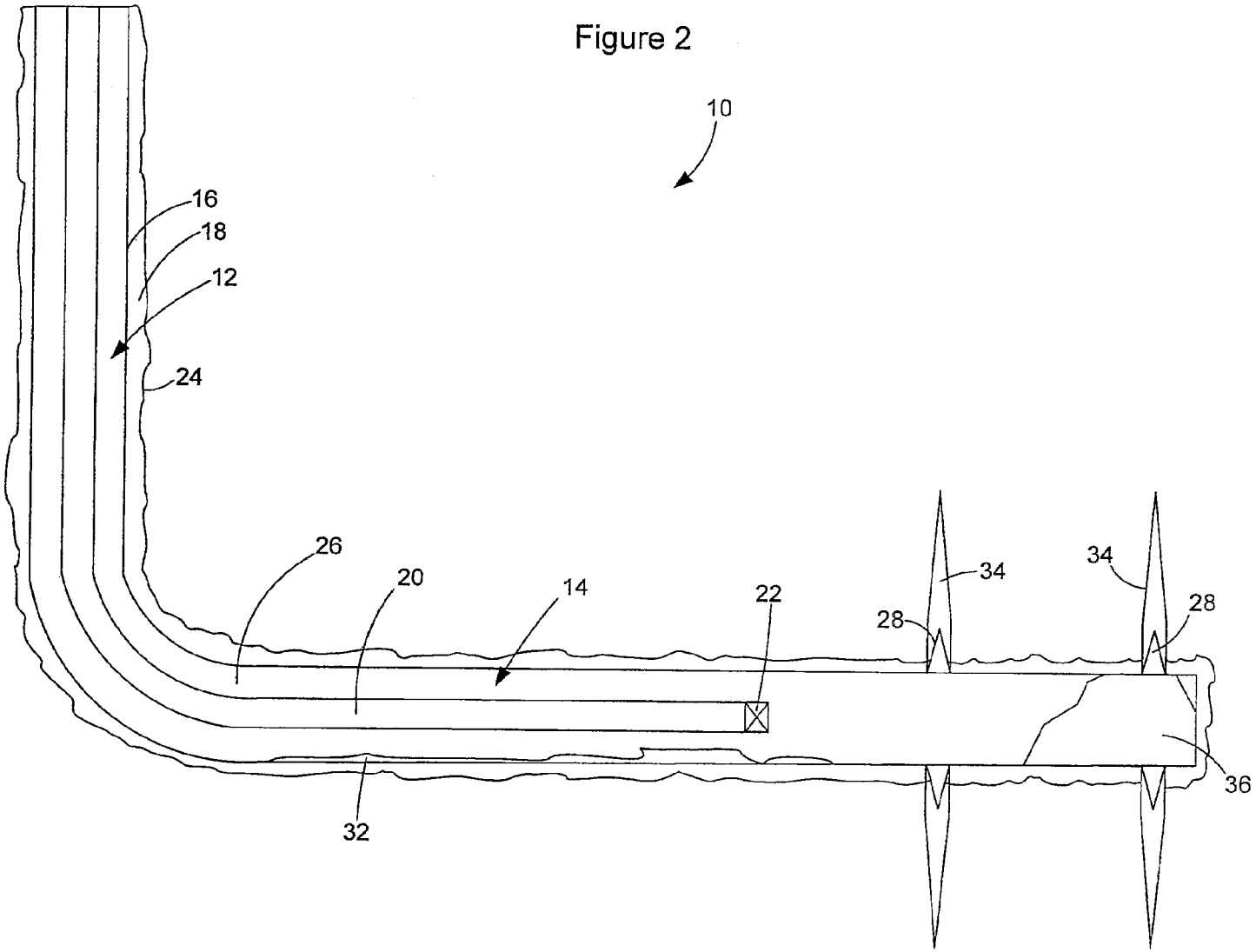
FIG. 2 is a schematic drawing of the well of FIG. 1 showing a second zone in the well closer to the heal of the well that has been abrasively perforated and hydraulically fractured and the abrasive perforator positioned even closer to the heal of the well.
Figure 3:
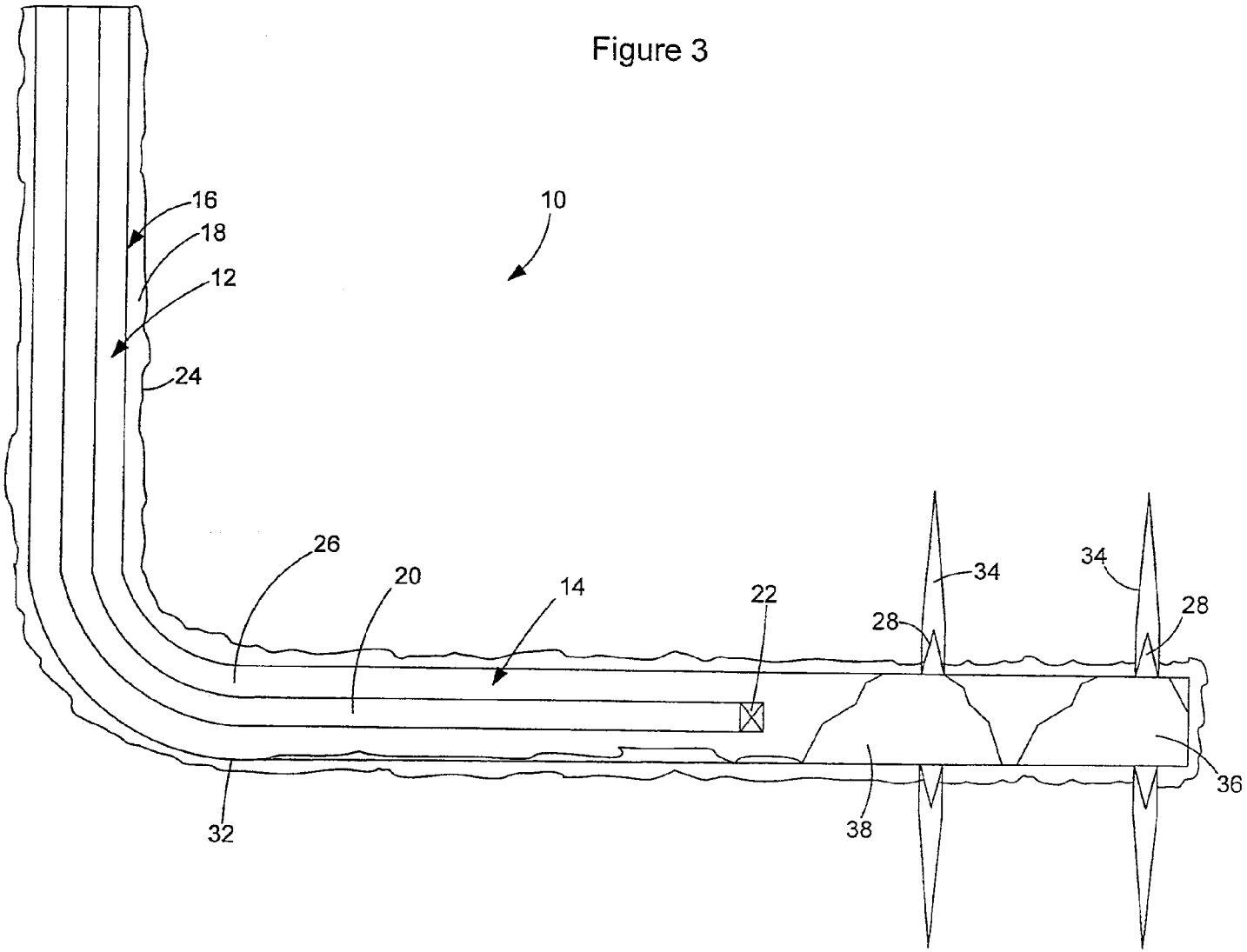
FIG. 3 is a cross-section of the well of FIG. 1 showing a sand plug placed in the second zone to provide zonal isolation.

FIGS. 1-3 depict a generic well 10 having a vertical bore 12 and a horizontal bore 14. The vertical bore may be at any particular angle and may be drilled and prepared using any particular means known in the art. Horizontal bore 14 extends away from vertical bore 12. Horizontal bore 14 may be also be drilled and prepared using any technique known in the art. The horizontal bore may be at any particular depth, such as 1000-3000 meters total true vertical depth (TVD). The horizontal bore may be of any particular length, such as 1000-2000 meters. It will be appreciated that the horizontal bore may not be exactly horizontal. For example, the horizontal bore may extend at an angle, upwardly or downwardly, for example, of from 75 to 100° measured from true vertical.

As exemplified in FIG. 1, well 10 has a casing 16 provided therein and cement 18, which is positioned between the casing and the formation 24. Accordingly, if formation 24 is to be hydraulically fractured, casing 16 and cement 18 must be perforated.

In order to perforate the barrier member, in this embodiment casing 16 and cement 18, abrasive perforation may be utilized. Accordingly, as exemplified in FIG. 1, coil tubing 20 with an abrasive perforator 22 at the end thereof may be inserted inside casing 16. Various designs for coil tubing 20 and abrasive perforator 22 are known in the art and any such design may be utilized. Further, abrasive perforator 22 may be operated in any manner known in the art.

Typically, an abrasive peroration fluid is pumped through the coil tubing 20 and ejected at high speed out of abrasive perforator 22 so as to perforate through the casing 16 and cement 18. The pump rate for the abrasive perforation may be from 0.1 to 1 $m^3$/min, more preferably from 0.3 to 0.85 and, most preferably from 0.45 to 0.6, although this dependent on the design and setup of the abrasive perforator tool. The abrasive perforation fluid may be any fluid known in the art. For example, the fluid may be water together with common industry additives such as a guar. In addition, an abrasive is entrained in the fluid. The abrasive is preferably a sand. The perforation of casing 16 and cement 18 may be evidenced, which is typically a rare occurrence, by a decrease in pressure in the coil tubing monitored at surface on the annulus 26.

As a result of, e.g., the abrasive perforation, abrasive, such as sand, may accumulate on the lower side of the casing (i.e. in the annular gap 26 between coil tubing 20 and the lower wall 32 of casing 16). At this stage, a clean out operation may be conducted. Pursuant to the clean out operation, fluid is pumped through coil tubing and return fluid may flow up annular gap 26. However, due to limitations of flow rate down the coil 20, velocities in annular gap 26, as well as the volumes of fluid that may be able to be pumped down the coil 20, an amount of particulate matter or sand 30 in annular gap 26 may not be cleaned out and deposited at the bend between vertical and horizontal well bores 12, 14. In such a case, if hydraulic fracturing is conducted in a normal manner, then sand 30 may be picked up and may block the formation, or the perforations, which have been created, thereby preventing the hydraulic fracture from occurring. This phenomenon is called sanding off of the formation. An example of such a sanding off is exemplified in Example 2.

Subsequently, such as following the abrasive perforation operation or the clean out operation, the hydraulic fracturing operation may be conducted. Pursuant to the hydraulic fracturing operation, a fluid may be pumped in annular space 26 (i.e. between coil tubing 20 and casing 16) to apply pressure to the formation adjacent the abrasively perforated casing 16 and cement 18. It will be appreciated that the abrasive perforation may have resulted in a channel being formed into formation 24 (generally represented by perforation 28 in FIG. 1).

As exemplified in Example 3, the hydraulic fracturing is conducted whereby the pump rate of the fracturing fluid is controlled according to a pump rate regime to initially break the formation while reducing a sufficient amount of residual sand 30 from annular gap 26 such that when full pump rates are achieved for hydraulic fracturing, sanding off of the formation may not occur. Accordingly, the fracturing operation may be conducted in three notional periods.

During the first period, fluid is pumped down annular gap 26 to break down the formation. The fluid is pumped at a rate sufficient to build up pressure in annular gap 26 and break the formation while reducing the pick-up of sand 30 deposited in annular gap 26 such that sanding off of the formation is reduced or does not occur. During this period of time, the fluid may be pumped at a rate of 0.3 $m^3$/min to 2 $m^3$/min and preferably from 0.3 to 1 $m^3$/min. Preferably, the pressure is increased slowly (e.g. at a rate of an increase of pump rate of 0.1 $m^3$/min/min). If the pressure increases beyond the desired level in the well 10, then this is indicative of too much sand 30 being entrained in the fluid flowing through annular gap 26 and the formation being sanded off. Accordingly, the pressure is reduced and the flow continued at a lower rate to break the formation.

Once the formation has been broken, then additional fluid is pumped through annular gap 26 to continue the fracturing operation. During this second period, the initial breaks or cracks in formation 24 are propagated. During this period fluid which has a reduced amount and, preferably, essentially no abrasive (such as sand) is pumped through annular gap 26. The flow rate is controlled so as to pick up sand 30 located at annular gap 26. This sand is entrained in the hydraulic fracturing fluid and is utilized as a proppant in the hydraulic fracturing operation. Preferably, the flow rate may be from 0.1 $m^3$/min to 3 $m^3$/min and, more preferably from 0.3 to 1.5 $m^3$/min.

During this second period, the pump rate is preferably slowly increased. If the pressure suddenly increases, then this would indicate that too much sand 30 was entrained and that the formation has been sanded off. In such a case, the flow rate in annular gap 26 may be reduced so as to allow sand to fall out of perforations 28 whereby the pressure in the well 10 may be reduced. The pump rate may then be increased again. The pump rate may continue to be increased until sufficient sand 30 has been entrained so as to permit a regular hydraulic fracturing pumping regime to be utilized. The hydraulic fracturing may then continue during a third period according to any desired hydraulic fracturing regime. For example, during this time, the pump rate may be from 1 $m^3$/min to 4 $m^3$/min, and, preferably from 2.0 to 4.0 $m^3$/min. This results in a hydraulically fractured formation generally indicated in the Figures by reference numeral 34.

During the first period of the operation, the fluid that is utilized is preferably a straight fluid (i.e., the fluid may comprise water and common industry additives such as guar but without any abrasive or essentially any abrasive). For example, the treatment fluid may include less than 200 kg of proppant (abrasive) per $m^3$ of fluid, preferably, less than 100 kg of proppant per $m^3$ of fluid.

Alternately, or in addition, during the second period the treatment fluid is preferably a straight fluid, which may be the same as or different to the fluid utilized during the first period.

During the third period, a hydraulic fracturing fluid is utilized which includes a proppant, which is preferably sand (proppant). It will be appreciated that any known hydraulic fracturing fluid may be utilized.

Subsequent to a section or zone of horizontal bore 14 being fractured, a second subsequent zone, which is closer to the heel of the well 10, may be hydraulically fractured. In order to hydraulically fracture this second section, the first zone is preferably isolated. A zone closer to the toe of the horizontal bore 14 may be isolated by sanding off the first zone (e.g., pumping a sand plug, positioning sufficient sand in the first zone so as to prevent fluid pumped into well 10 during the hydraulic fracturing of a subsequent zone from traveling into the hydraulically fractured formation in the first zone). Accordingly, a sand plug 36 may be deposited in the first zone. Alternately, a mechanical isolation member as is known in the art may be utilized. Prior to or during this operation, coil tubing 20 and abrasive perforator 22 may be withdrawn towards the heel of the well 10 and positioned so as to conduct a hydraulic fracturing operation in a second zone. The second zone is preferably the zone next closest to the heel of well 10. This is the position of abrasive perforator 22 that is shown in FIG. 1. The procedure may then be repeated. Accordingly, perforations 28 may be formed in the second zone (which is shown in FIG. 1). Subsequently, the hydraulic fracturing operation may be conducted in the second zone and a second hydraulically fractured formation 34 produced at the second zone (see FIG. 2). This procedure may then be repeated again. For example, as shown in FIG. 3, the coil tubing 20 has been withdrawn to a further section closer to the heel of well 10 and a further sand plug 38 has been positioned in the second zone to thereby isolate the second zone from the third zone to be treated.

EXAMPLES

Example 1

Figure 4:
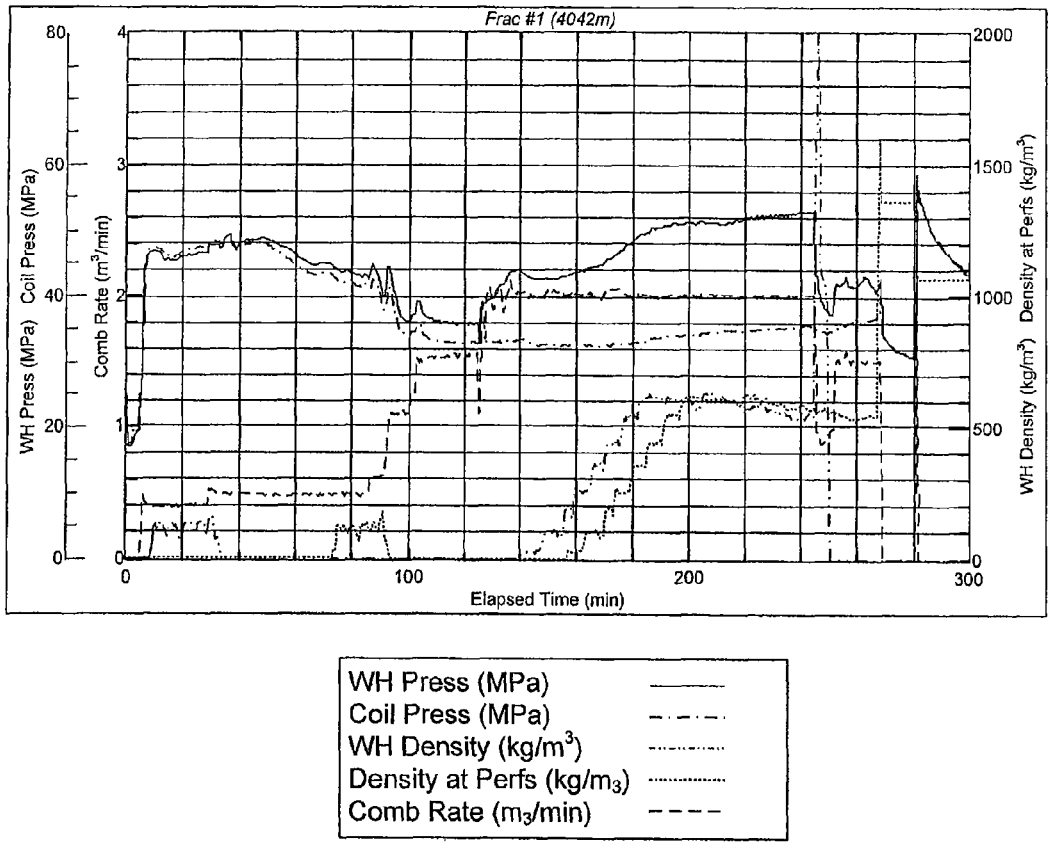
FIG. 4 is a graph exemplifying a standard hydraulic fracturing treatment operation.

A standard hydraulic fracturing treatment operation is exemplified by FIG. 4. This operation was conducted subsequent to the abrasive perforation of the casing and cement.

The initial process is to break down the formation. As exemplified in FIG. 4, the combined rate of fluid that is pumped into a well bore increases to 0.4 cubic meters per minute at five minutes of elapsed time. This increases the well head pressure to about 48 MPa. The pump rate is held constant until the thirty minute elapsed time mark at which time it is increased to 0.5 cubic meters per minute. The pressure gradually increases during this time until, at about fifty minutes, the pressure starts to reduce. This is considered to be the time at which the break down of the formation occurs.

The pump rate is kept constant with the pressure decreasing. This is considered to represent a further break down of the formation (i.e. the width and/or height and/or length of the fractures in the formation are growing during this stage). At about ninety minutes, the pump rate is increased in steps. This results in increases in pressure initially. However, the increased pressure further breaks down the formation and results in a drop in pressure in the well. Once a pump rate is increased to 1.5 cubic meters per minute (at about one hundred and twenty five minutes of elapsed time), the pump rate is held constant and hydraulic fracturing fluid is pumped into the well.

Example 2

Figure 5:
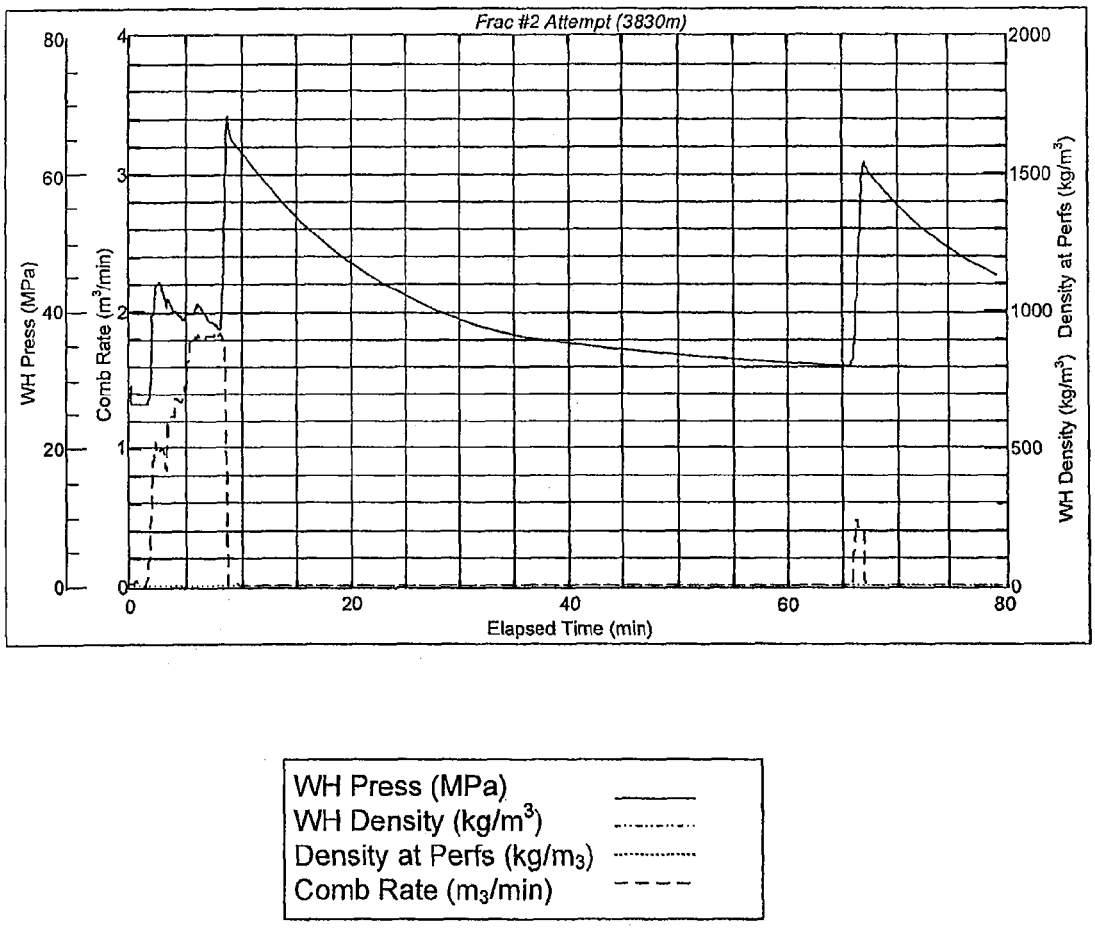
FIG. 5 is a graph exemplifying a hydraulic fracture treatment with sand issues: and, FIG. 6 is a graph exemplifying a hydraulic fracturing operation in accordance with this invention.

FIG. 5 exemplifies a hydraulic fracture treatment where sand present in the horizontal section of the well impedes the fracturing operation. This operation was conducted subsequent to the abrasive perforation and hydraulic fracturing of a first zone and the abrasive perforation of the casing and cement of a second zone. As shown in FIG. 5, the pump rate is increased to about 1.8 $m^3$/min in about 10 minutes. The well head pressure initially increases sharply from 45 MPa to 40 MPa. The pressure then decreases to about 38 at about 8 minutes of elapsed time whereupon the pressure suddenly spikes to about 67 MPa. At this time, the pump rate drops to about 0. This is indicative of a sand off.

The sand off prevented further effective fracturing of that section of the formation. The volume of fluid that was pumped prior to the drop in the combined pump rate was equivalent to the volume between the abrasive perforations and the 45/90° deviation in the well. This indicates that the flushing of the well by pumping fluid down the coil and back up the annulus did not clean out the abrasive perforating sand from the well. Sand remained in the horizontal section of the well and was re-entrained by the hydraulic fracturing fluid and resulted in sanding off of the fracturing operation.

Example 3

Figure 6:
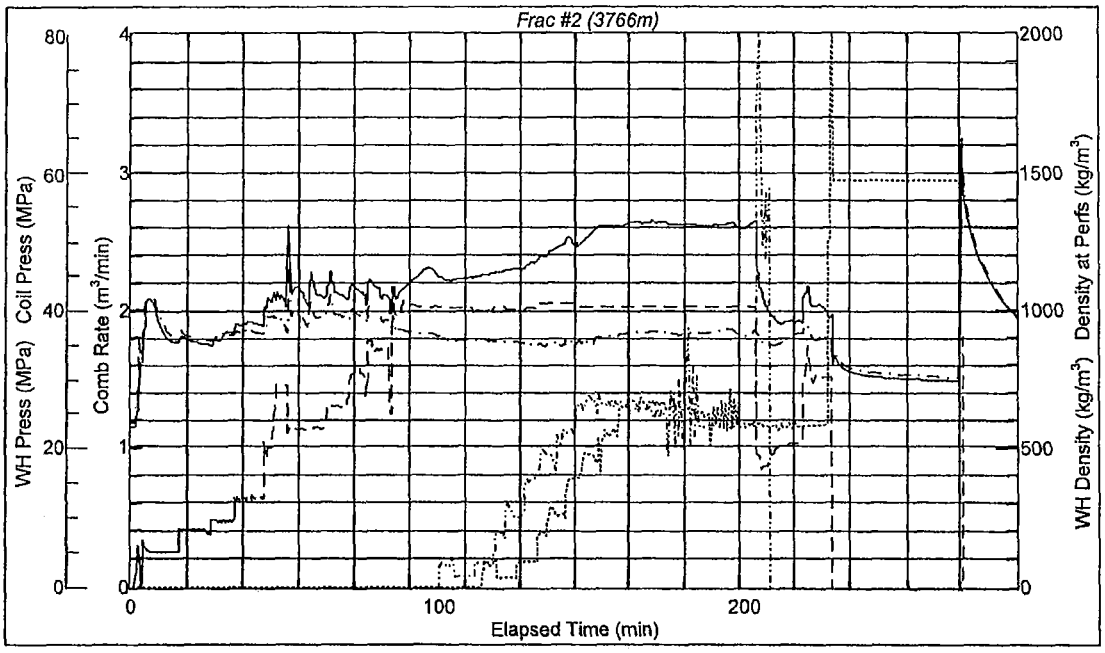

This example exemplifies a hydraulic fracturing treatment using controlled flow rate fracturing according to this invention (see FIG. 6 and Table 1). This operation was conducted subsequent to the abrasive perforation of the casing and cement.

A fluid (water and a guar additive) was initially pumped into the well at about 0.4 $m^3$/min. The formation was broken at about 10 minutes elapsed time when the pressure climbed to 42 MPa. The break is indicated by the roll over or drop in pressure. The pump rate was slowly increased in steps to entrain sand from the well 14 in the fluid stream. At 45 minutes, the pump rate was increased to 1.4 $m^3$/min and the pressure spiked to 50 MPa. This increase in pressure indicated that the formation was sanding off. Accordingly, the pump rate was immediately reduced to about 1.15 $m^3$/min and the pressure decreased. The pump rate was then slowly increased in stages and small pressure spikes were detected. The pressure spikes indicated that sand was almost being entrained at a rate faster than it could be accepted by the formation. Since the pressure spikes were lower than the maximum pressure of the equipment/casing (65 MPa) the job was continued.

This process was continued until the pump rate was increased to 2 $m^3$/min. This occurred at 95 minutes of elapsed time. At this point, the pump rate was typical of that used for hydraulic fracture treatments. This indicated that all of the sand that could be re-entrained had already been re-entrained and pumped into the formation. At this time, a fracturing fluid was pumped into the well bore and the fracture treatment continued in the normal course.

The fracturing fluid that was utilized was water with a polymer, namely CMHPG (carboxymethylhydroxypropyl) guar with 50/140 sized proppant. It will be appreciated that any sized proppant e.g. 40/70, 30/50, 20/40, 12/20 and 16/30 could be used as well as any type of sand (e.g. natural or ceramic or resin coated). It will also be appreciated that a polymer based fluid could be utilized as well. These fracturing fluids could be pumped with numerous additional treatment chemicals such as a cross-linker or clay stabilizers etc. and other liquids or gases such as $CO_2$ and $N_2$.

It will be appreciated that an appliance or an electricity conducting cord may utilize one or more of the features disclosed herein. Further, what has been described above has been intended to be illustrative of the invention and not limiting and it will be understood by a person skilled in the art that other variants and modifications may be made without departing from the scope of the invention as defined in the claims appended hereto.

TABLE 1

| | | | Calculated | |
|---|---|---|---|---|
| Stage | Rate m3/min | Time mins | Volume (m3) | Velocities (m/sec) |
| 1 | 0.29 | 12.4 | 3.596 | 0.840 |
| 2 | 0.42 | 11 | 4.620 | 1.216 |
| 3 | 0.50 | 7.1 | 3.550 | 1.448 |
| 4 | 0.64 | 9.6 | 6.144 | 1.853 |
| 5 | 1.00 | 2.4 | 2.400 | 2.896 |
| 6 | 1.11 | 0.5 | 0.555 | 3.214 |
| 7 | 1.24 | 0.8 | 0.992 | 3.590 |
| 8 | 1.44 | 3.8 | 5.472 | 4.170 |
| 9 | 1.14 | 12.9 | 14.706 | 3.301 |
| 10 | 1.30 | 7 | 9.100 | 3.764 |
| 11 | 1.52 | 6.4 | 9.728 | 4.401 |
| 12 | 1.70 | 7.7 | 13.090 | 4.922 |
| 13 | 2.00 | 25 | 50.000 | 5.791 |

The invention claimed is:

1. A method of hydraulically fracturing a formation comprising:

(a) abrasively perforating a barrier member positioned in a first section of horizontally extending well bore;

(b) obtaining an estimated pump rate for fracturing the formation;

(c) pumping a first hydraulic fracturing fluid into the well bore during a first period to break down the formation while monitoring well head pressure and reducing the flow rate of the first hydraulic fracturing fluid if a pressure rise and/or a reduction of flow rate indicates that a sanding off condition is occuring;

(d) subsequent to a pressure drop indicative of the breaking of the formation, pumping a second hydraulic fracturing fluid into the well bore at a higher rate than in step (c) during a subsequent second period to fracture the formation and pick up sand positioned in the well bore while monitoring well head pressure and reducing the flow rate of the second hydraulic fracturing fluid if a pressure rise and/or a reduction of flow rate indicates that a sanding off condition is occuring; and, (e) during a subsequent third period, increasing the pump rate at least towards the estimated pump rate to fracture the formation.

2. The method of claim 1 further comprising (a) hydraulically fracturing a distal section of the well bore positioned closer to a heel of the well bore then the first section; and, (b) isolating the distal section from a first section of the well bore prior to abrasively perforating the barrier member positioned in a first section.

3. The method of claim 2 further comprising abrasively perforating a barrier member positioned in the distal section of the well bore prior to hydraulically fracturing the distal section.

4. The method of claim 1 wherein the pump rate varies during each of the first period and the second period.

5. The method of claim 1 wherein straight fluid is used during the first period.

6. The method of claim 1 wherein straight fluid is used during the second period.

7. The method of claim 1 wherein straight fluid is used during the first and the second periods.

8. The method of claim 1 wherein fluid that includes a proppant is used during the third period.

9. The method of claim 1 wherein, during the second period, the pump rate is increased from time to time and the pumping monitored to determine if the sand has been picked up from the well bore prior to commencing the third period.

10. The method of claim 1 wherein in the first period, the pump rate is less than 1 $m^3$/min.

11. The method of claim 1 wherein in the second period, the pump rate is greater than 0.3 $m^3$/min.

* * * * *